US006315235B1

(12) United States Patent
Breyer et al.

(10) Patent No.: US 6,315,235 B1
(45) Date of Patent: Nov. 13, 2001

(54) ROLL TENSIONER

(75) Inventors: Phillip Breyer, Simi Valley; Douglas L. Harb, Woodland Hills; Thomas M. Zevin, Canoga Park; Alexander Peter, Van Nuys, all of CA (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 09/393,149

(22) Filed: Sep. 10, 1999

Related U.S. Application Data

(60) Provisional application No. 60/106,895, filed on Nov. 3, 1998.

(51) Int. Cl.[7] ..... B65H 16/02; B65H 23/08; B65H 75/24

(52) U.S. Cl. ..... 242/422.4; 242/571.5; 242/578.2; 242/598.3; 242/599.3

(58) Field of Search ..... 242/422.4, 423, 242/423.1, 423.2, 422, 571.4, 571.5, 578.2, 598.3, 599.3

(56) References Cited

U.S. PATENT DOCUMENTS 3,516,342 * 6/1970 Luescher ..... 242/578.2
3,730,452 * 5/1973 Schwartz ..... 242/598.3
3,974,974 * 8/1976 Nishikawa ..... 242/422.4
4,625,931 * 12/1986 Tamura et al. ..... 242/423.1
4,842,215 * 6/1989 Takami ..... 242/422.4
4,854,519 * 8/1989 Maeda et al. ..... 242/422.4
5,076,510 * 12/1991 Norlander ..... 242/422.4
5,374,007 * 12/1994 Murison ..... 242/598.3
5,551,647 * 9/1996 Browning ..... 242/578.2
5,769,350 * 6/1998 Oka ..... 242/422.4
5,884,860 * 3/1999 Ishikawa et al. ..... 242/422.4
5,947,409 * 9/1999 Corrigan ..... 242/422.4

* cited by examiner

*Primary Examiner*—John M. Jillions
(74) *Attorney, Agent, or Firm*—Fulbright & Jaworski L.L.P.

(57) ABSTRACT

An image forming device includes a roll tensioner adapted to hold a medium roll rotatably mounted thereon for providing a printable medium strip to the imaging device. The roll tensioner comprises a torsion mechanism exerting torsion to the printable medium strip that tends to pull back the printable medium strip and, thus, to prevent slack of the printable medium strip, the roll tensioner further including a torsion control mechanism to prevent the torsion from getting too large to stop the rotation of the printable medium roll, the roll tensioner also including a clutch mechanism to prevent damage to the torsion mechanism.

19 Claims, 5 Drawing Sheets

FIG. 3a
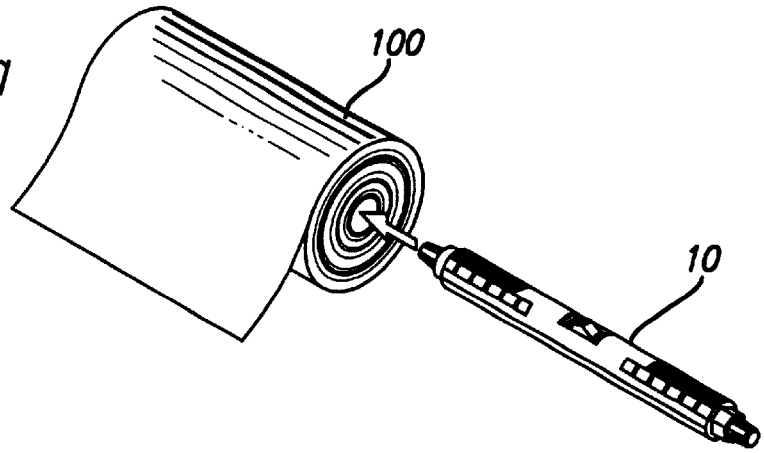
FIG. 3b
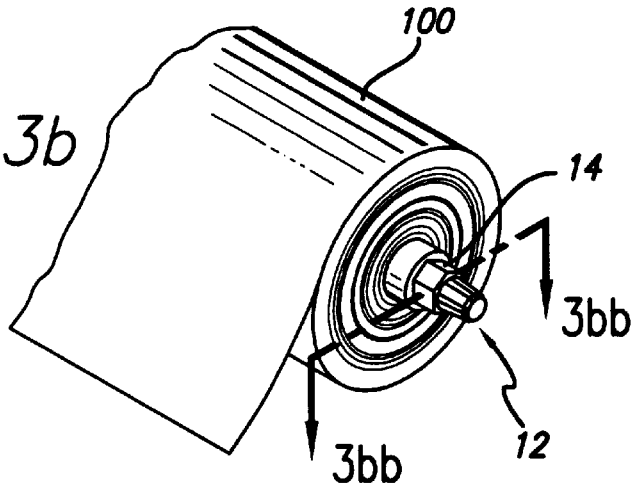
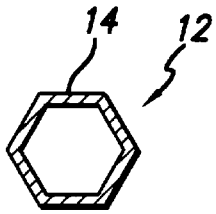
FIG. 3bb
FIG. 3c
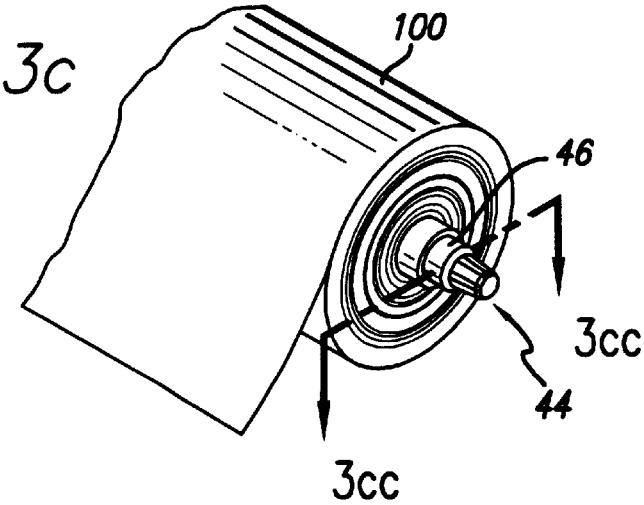
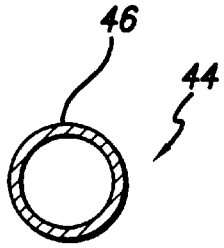
FIG. 3cc

ROLL TENSIONER

This application is based upon provisional patent application Ser. No. 60/106,895 which was filed in the United States Patent and Trademark Office on Nov. 3, 1998.

FIELD OF THE INVENTION

The present invention relates generally to an image forming device, and more particularly to a roll holder/tensioner adapted to be incorporated into a printer for holding a printable medium roll and for providing tension on the printable medium strip to prevent looping, jamming, or other printing problems associated with a slack printable medium moving in the image forming device.

BACKGROUND OF THE INVENTION

All conventional image forming devices are designed to form images on printable media that are fed into the image forming devices either by external feeding devices coupled to the image forming devices or by certain internal feeding mechanisms incorporated into the image forming devices. Ordinarily, the printable media has at least one side of its surface suitable for forming information-carrying images thereon. However, many commercially available printable media have printable surfaces on both sides. There are many types of printable media available in the market, such as regular papers, labels, or thermal paper, etc. Thus, every conventional image forming device is adapted to receive at least one type of printable medium for printing purposes. In addition, many different types of image forming devices, e.g., printers, fax machines, or copiers, etc., are also available in the market, and the methods these image forming devices use to impart images on the printable media are often very different. For example, some image forming devices need ribbons to transfer images to the printable medium, while others use a direct thermal transfer method to form images on the printable medium.

Moreover, even one type of commercially available printable media may have many different forms. For instance, the printable media may come in the form of separate sheets, or it may be in the form of a continuous paper strip. Consequently, different types of feeding mechanisms are specially designed and are adapted to be incorporated into selected printers for respectively feeding these different forms of printable media into the printers. Separate sheets of plain paper are undeniably still the predominant printable medium type that is used in today's business applications. There is, however, an ongoing need to have a printable medium in the form of a strip wrapped into a printable medium roll. Typically, this printable medium roll, such as a label roll, has the printable medium strip, such as a label strip, winding around a cardboard support tube, or a similarly shaped tube made by other suitable materials. In the case of a label roll, the label roll has serially arranged labels positioned on the label strip, and each label of the label strip has a printable surface on a front side and an adhesive back side attached to a continuous protective backing of the label strip. The protective backing of the label strip generally has a treated glossy surface attached to the adhesive side of the labels permitting the labels to be easily peeled off from the protective backing. The labels are then, together with the protective backing strip, wound around the support tube to form the label roll.

Most conventional printers have relatively simple holding mechanisms incorporated therein for holding label rolls. Typically, a conventional printer includes either a cylindrically shaped roll holder transversely positioned across the printer or, alternatively, two ear-like spool ends positioned at corresponding opposite inner sides of the printer. As a result, the label strip in the printer normally moves in a forward direction, which is perpendicular to the axis of the label roll, toward a front side of the printer. The roll holder, or the pair of spool ends, of the conventional printer function to hold the label roll in order to facilitate the label strip to be unwound and moved toward a print head of the printer. Each conventional printer has a print head, and the print head is the part of the printer that converts electrical signals into images formed on the printable medium, such as the label strip. Additionally, a platen is rotatably mounted within the printer and is adapted to press the label strip tightly against the print head for receiving the images. The platen is coupled to a motor for rotation in order to move the label strip through the printer. In some conventional printers, their cylindrically shaped roll holders (and/or the ear-like spool ends, do not themselves rotate during operation of the printers. They work only as a stationary roll holder support for the printable media. In other printers, the roller holders or the spool ends are rotatable.

Most conventional printers, and other image forming devices that use printable medium rolls, often experience a common problem of loose media. The loose media problem happens when the printable medium strip traveling within the printer becomes loose before and/or after being fed through the print head of the printer. There are different reasons that may cause the loose media problem in conventional printers, but it is almost impossible to predict when or how often this loose media problem will happen to any particular printer. The loose media problem frequently causes printing errors, such as skid printing or double printing, on the printable medium. It may possibly jam the conventional printer as well.

The loose media problem generally occurs when various parts of the printable medium strip travel through the conventional printer at slightly different speeds. The speed differences experienced by different parts of the medium strip are normally due to the inability of the conventional printer to move the printable medium strip at a constant speed throughout the printer. For instance, the platen of the conventional printer may move the label strip at a first speed that is slower than, albeit maybe slightly, a second speed traveled at by the label strip moved by the roll holder. As a result, a section of the label strip between roll holder and the platen may become loose.

In addition, a user may often need to move forward and/or back up the printable medium strip in the printer in order to adjust the position of the printable medium strip within the printer. Moving forward or backing up the printable medium strip in the printer is ordinarily achieved by rotating, manually or automatically by a motor of the printer, the platen of the printer. After the platen has been rotated to adjust for a proper printing position of a particular label on the label strip, the label roll will also need to be adjusted accordingly to maintain the tightness of the label strip between the label roll and the print head. Otherwise, the label strip will become loose and may cause many printing problems, such as a sudden jerk or a jump, when the next printing job begins. A built-in mechanism of the printer is therefore needed to maintain tightness of the label strip, or of any other type of printable media used, within the printer to prevent the loose media problem.

SUMMARY OF THE INVENTION

An object of the present invention is to provide a tension mechanism incorporated into an image forming device in order to maintain a proper tension level in a printable medium strip, such as a label strip, thereby to prevent the loose media problem of the medium strip commonly experienced by many conventional printers. This object is met by providing a roll tensioner incorporated into a printer according to the present invention, as indicated in the claims appended thereto.

Accordingly, a preferred embodiment of the present invention provides the roll tensioner incorporated into the printer for holding a printable medium roll having the medium strip wound thereon. The roll tensioner has an internal tension mechanism adapted to constantly maintain a proper tension level on a portion of the printable medium strip, which extends from out of the medium roll toward the print head of the printer. According to the present invention, the tension level on that portion of the medium strip will be properly maintained both during unwinding or rewinding of the medium roll, whether automatically driven by a motor of the printer or manually driven by other means.

The foregoing and additional features and advantages of this present invention will become apparent byway of non-limitative examples shown in the accompanying drawings and detailed descriptions that follow. In the figures and written description, numerals indicate the various features of the invention, like numerals referring to like features throughout for both the drawing figures and the written description.

BRIEF DESCRIPTION OF THE DRAWINGS

FIG. 3*a*–3*c* show the roll tensioner inserted into a medium roll to be mounted on the printer.

FIG. 3*bb* is a cross-sectional view taken along section line 3*bb*—3*bb* of FIG. 3*b*.

FIG. 3*cc* is a cross-sectional view taken along section line 3*cc*—3*cc* of FIG. 3*c*.

DETAILED DESCRIPTION OF THE INVENTION

Figure 1:
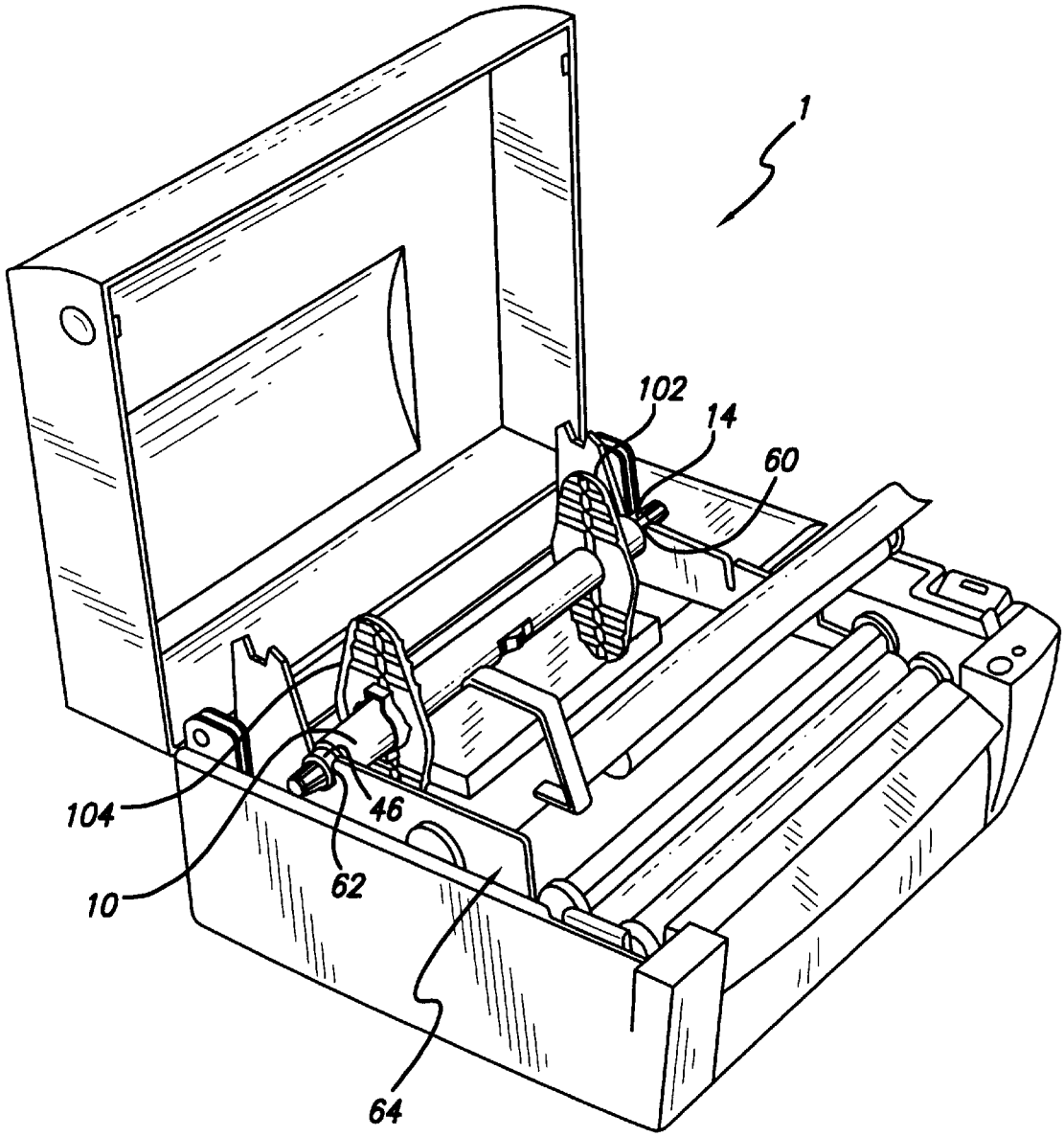
FIG. 1 shows a printer that incorporates a roll tensioner according to the present invention.

FIG. 1 shows a roll tensioner 10 according to the present invention incorporated into a printer 1 depicted in an open loading position. In FIG. 1, the roll tensioner 10 is positioned inside the printer 1 near a back end. In a preferred embodiment of the invention, the printer 1 includes a support frame 64 having a pair of roller slots 60, 62 (FIG. 1) respectively located at opposite side ends of the support frame 64 and near the back end of the printer 1. Roll tensioner 10 is coupled to the support frame 64 by insertion into the roller slots 60, 62. Roll tensioner 10 is in a generally stepped-cylindrical shape with a diameter of approximately 1 inch at a center main portion and is suitable to hold a printable medium roll, such as a label roll 100, mounted thereon. In the preferred embodiment, the roll tensioner 10 is also directionally sensitive and will not work properly if it is incorrectly installed in the printer 1, as will be explained in further details. Accordingly, roll tensioner 10 has a pair of differently shaped end caps respectively located at opposite ends (left and right) to help a user determine which end of the roll tensioner 10 should mesh with which roller slot (60 or 62) of support frame 64 of printer 1. Roller slots 60, 62 also have different matching shapes respectively to house the correspondingly shaped end caps of roll tensioner 10 (FIG. 1).

Figure 2:
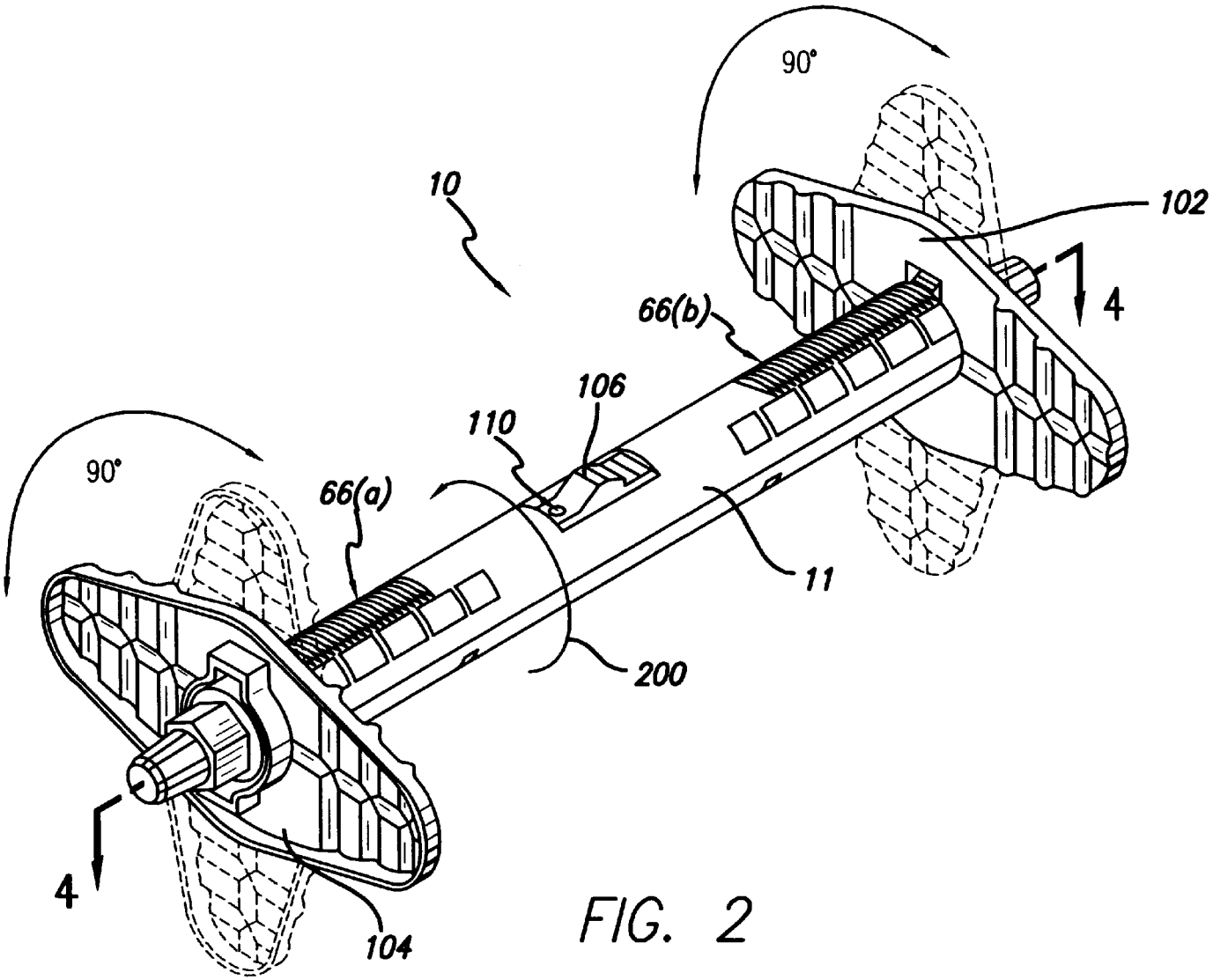
FIG. 2 shows an isometric view of the roll tensioner of the present invention.

In the preferred embodiment, the roll tensioner 10 also includes a pair of retainers 102, 104 respectively coupled to the roller tensioner 10 at opposite sides (left and right), as shown in FIGS. 1 and 2. The retainers 102, 104, however, can be dispensed with in other alternative embodiments of the present invention. The retainers 102 and 104 are adopted for the purpose of securing a lateral position of the printable medium roll mounted on the roller tensioner 10, thereby the printable medium roll will not move laterally during the operation once mounted on the printer 1. Referring to FIG. 2, the roll tensioner 10 comprises a tube sleeve 11 having two sets of surface notches 66*a*, 66*b* positioned at opposite sides on the surface of the tube sleeve 11. The tube sleeve 11 is approximately 9.13 inches long, and each set of the notches 66*a* or 66*b* is approximately 2.4 inches long respectively extending from the opposite ends toward the center of the tube sleeve 11. Scale indicators positioned adjacent to both sets of the notches 66*a*, 66*b* may also be provided for indicative purposes. The scale indicators may be of alphabetical letters or of numerical numbers, but they should be in a same alphanumeric set at both sides and, preferably, should ascend the alphanumeric order from the center to the opposite ends of the tube sleeve 11 for easy reading. Additional sets of notches (not shown) may also be included and are respectively positioned on the surface at approximately diametrically opposite sides to the sets of notches 66*a*, 66*b*.

Figure 5:
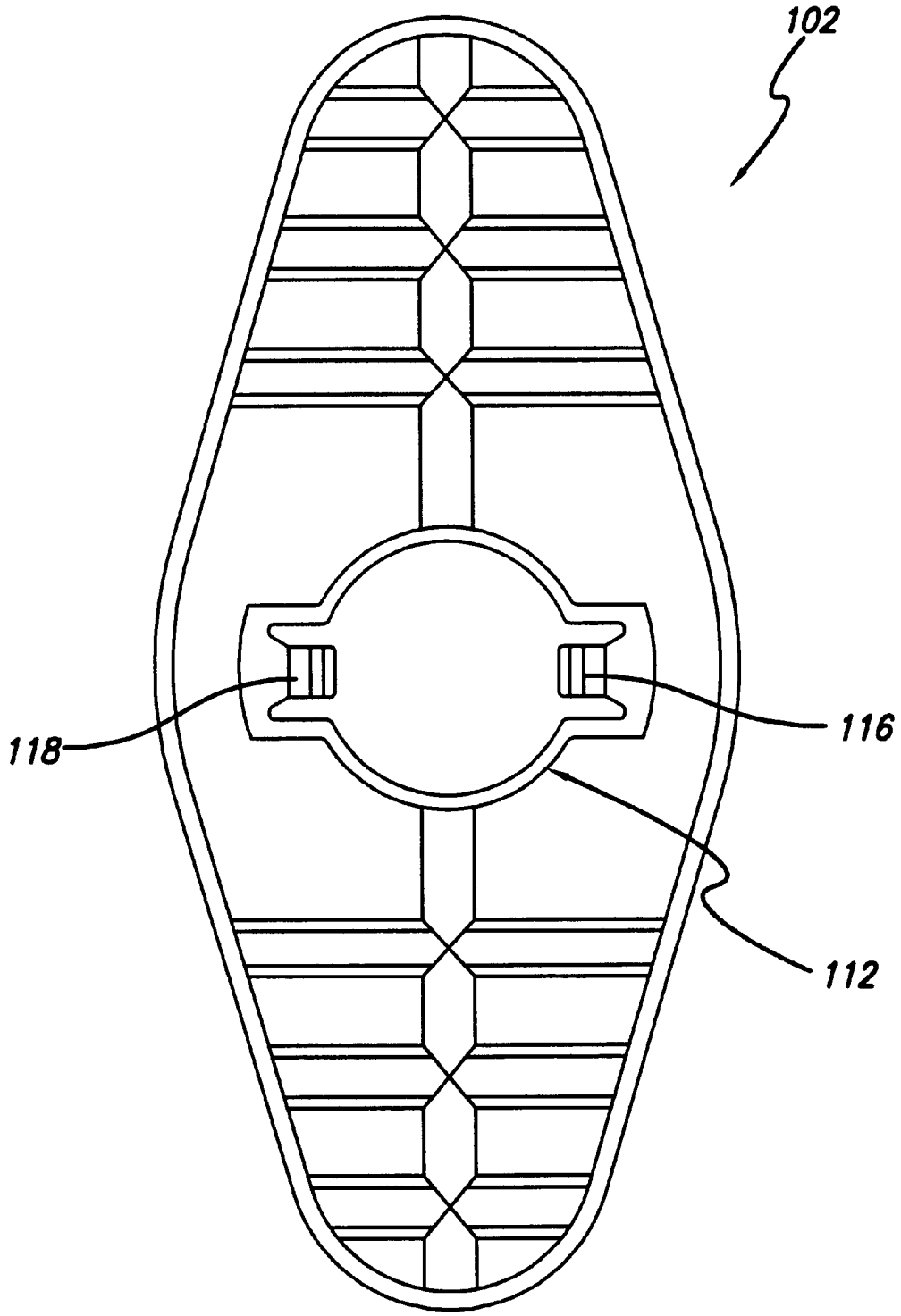
FIG. 5 shows a retainer of the present invention.

Referring to FIG. 5, the retainers 102, 104 are of generally rhomboidal shape but with smoothly round angles at each apex. In the preferred embodiment, each retainer 102 or 104 is approximately 5 inches long and approximately 2.25 inches wide. Each of the retainers 102, 104 has a generally round center hole such as center hole 112 (FIG. 5) having a diameter slightly larger than 1 inch. The center holes of the retainers 102, 104 have detent-snap-like notches 116, 118 on their respective innerwalls of the center holes. As a result, the retainers 102, 104 are adapted to be snapped onto the surface notches 66*a*, 66*b* of the roll tensioner 10 at both ends, as shown in FIG. 2. The retainers 102, 104 are adapted to trap the label roll 100 on the roll tensioner 10 between the retainers 102, 104. Therefore, if the retainers 102, 104 tightly confine the label roll 100 in between, the label roll 100 will not move laterally along the roll tensioner 10 when the label roll 100 rotates during the operation of the printer 1, thereby helping to prevent misalignment of the label strip in the printer 1. In addition, the retainers 102, 104 are also adapted to center the label roll 100 on roll tensioner 10. The scale indicators on roll tensioner 10 will indicate the positions of the retainers 102, 104 respectively once they are mounted on the roll tensioner 10. Thus, the user may easily center the label roll 100 on the roll tensioner 10 by adjusting the respective positions of the retainers 102, 104 that are indicated by the scale indicators. As a result, although the retainers 102, 104 may be optional to the present invention as mentioned, they are particularly useful when a narrow printable medium roll is used for printer 1.

Referring to FIG. 2, roll tensioner 10 further includes two holding springs 106, 108 respectively positioned on the surface center of the tube sleeve 11 at diametrically opposite sides. Each holding spring 106 or 108 is placed on a corresponding recess of the surface of the tube sleeve 11, and a center portion of the holding spring 106 or 108 protrudes slightly above the surface of the tube sleeve 11 to hold the support tube of the label roll 100. The center portions of the respective holding springs 106, 108 are adapted to be pressed downward slightly toward the surface of the tube sleeve 11. In the preferred embodiment, each holding spring 106, 108 is basically a piece of curved metal plate and is securely mounted on tube sleeve 11 (see FIG. 4) of roll tensioner 10 by a screw such as screw 110 (FIG.2). The holding springs 106, 108 are of approximately 1.25 inches in bent length respectively. In an alternative embodiment, only one holding spring is provided to the present invention, as compared to the preferred embodiment which has two holding springs. In yet other alternative embodiments, other suitable elastic means may be used in lieu of the holding springs 106, 108 so long as they serve a similar purpose, i.e., holding the printable medium roll.

Figure 4:
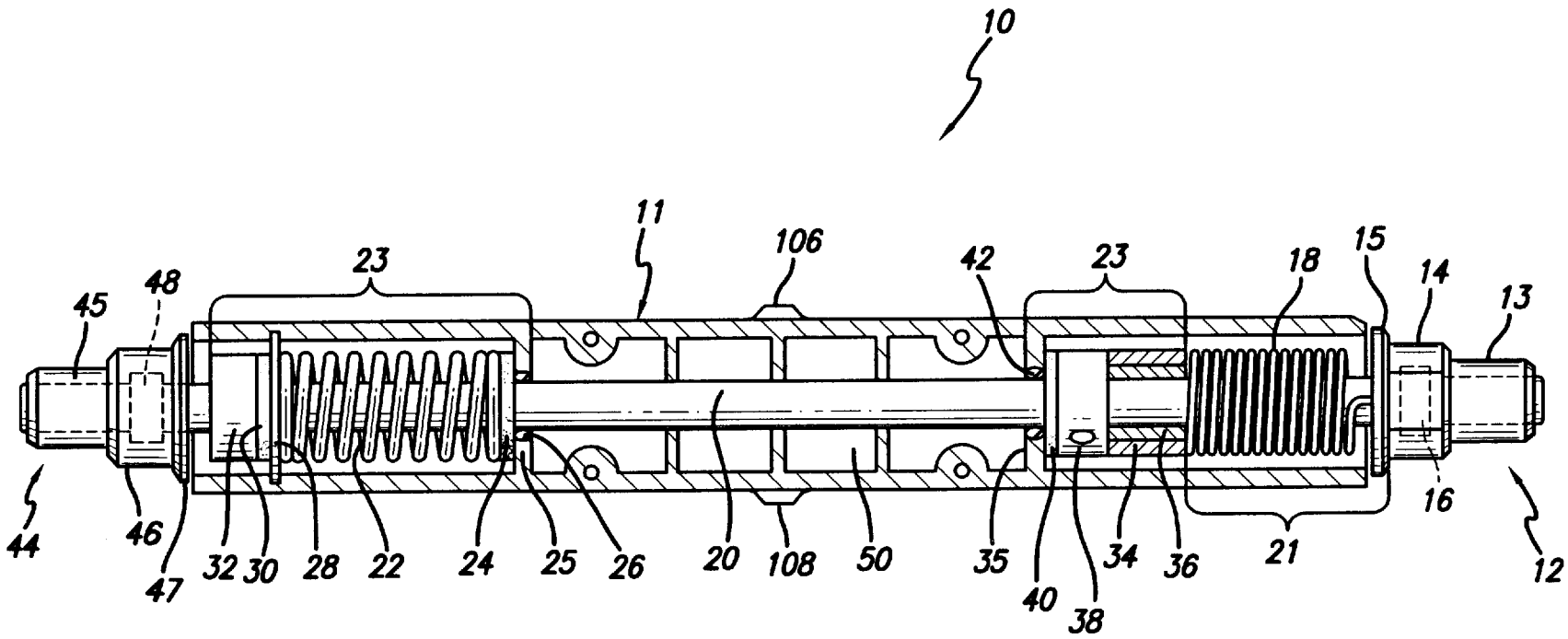
FIG. 4 is a cross-sectional view taken along section line 4—4 of FIG. 2 excluding the retainers of FIG. 2.

FIGS. 3*a*–3*c* show the roll tensioner 10 being inserted into the label roll 100 for mounting on the printer 1. In FIG. 3*b*, the roll tensioner 10 is inserted into the label roll 100 correctly, while the roll tensioner 10 is inserted incorrectly in FIG. 3*c*. As shown in FIGS. 3*bb* and 3*cc*, the roll tensioner 10 has first and second stepped end caps 12 and 44 respectively of different outer periphery shapes. Both of the first and second end caps 12, 14 are approximately 1.1 inches long and are located at opposite ends of the roll tensioner 10 respectively. In FIG. 4, the first stepped end cap 12 has first and second sections 13, 14 and a collar 15, wherein the first section 13 has an outer diameter, of approximately 0.5 inch. The collar 15 has an outer diameter of approximately 0.9 inch, that is larger than that of the second section 14, and an inner diameter of approximately 0.6 inch. Second section 14 has a hexagonal cross section (FIG. 3*bb*) with a flat to flat distance of approximately 0.7 inch. First section 13 is tubular shaped while collar 15 is of ring shape. Second stepped end cap 44 also has first and second sections 45,46 and a collar 47. Both the first and second sections 45, 46 are of cylindrical tube shape wherein the first section 45 has a similar diameter as the diameter of the first section 13 of the first stepped end cap 12. Second section 46 has an outer diameter of approximately 0.7 inch (FIG. 3*cc*), which is larger than that of first section 45. The collar 47 is of round shape and has a diameter size similar to the diameter size of the collar 15, which is larger than that of second section 46.

FIG. 4 shows a cross sectional view of the roll tensioner 10. The roll tensioner 10 includes a metal shaft 20 encircled within the tube sleeve 11. The shaft 20 is approximately 11.5 inches long and has a diameter of approximately 5/16 inch. The length of the shaft 20 is slightly longer than a combinational length of the tube sleeve 11 and both end caps 12 and 44. Thus, the shaft 20 extends through and slightly outward of both stepped end caps 12 and 44 when mounted. The shaft 20 is coupled to a slip mechanism 23 (FIG. 4), which will be elaborated further in the following paragraphs, and is adapted to be rotated by the slip mechanism 23 in a rotational direction, opposite to a relative rotational direction of the tube sleeve 11. Further, a torsional mechanism 21 (FIG. 4) is coupled to slip mechanism 23 and has elastic means to impart tension on label roll 100. In the preferred embodiment, the elastic means shall not be permitted to rotate in a rewinding rotation to prevent the elastic means from being damaged. Both the stepped end caps 12 and 44 have cylindrical channels therein to allow the shaft 20 to pass through. The tube sleeve 11 and both the end caps 12 and 44 are made of plastic materials in the preferred embodiment, but any other suitable materials may be used to manufacture the same.

As mentioned, in contrast to the hexagonal shape of second section 14 of first stepped end cap 12, second section 46 of second stepped end cap 44 is of to round shape. The shape difference between the first and second sections 14 and 46 is particularly useful because it prevents a user from accidentally inserting roll tensioner 10 into the printer in a wrong orientation, opposite of that shown in FIG. 1. As mentioned above, printer 1 has respective roller slots 60 and 62 on opposite side ends of the printer 1 for housing end caps 12 and 44, respectively, of roll tensioner 10. Roller slot 60 has a matching hexagonal shape to receive section 14 (FIG. 1), and roller slot 62 has a matching round shape to receive section 46 (FIG. 1). By giving different shapes to end caps 12 and 44, and the respective matching shapes of roller slots 60 and 62, a user will, therefore, not make mistakes in installing roll tensioner 10 into printer 1 and, thus, ensure that roll tensioner 10 will function properly during operation. In an alternative embodiment, the shapes of both sections 14, 46 could be exchanged, so long as the respective roller slots 60, 62 will also change their matching shapes as well. In yet another embodiment, sections 14, 46 could have shapes other than hexagonal and round. But the matching shapes of the roller slots 60, 62 shall also be changed accordingly.

Furthermore, once end caps 12 and 44 are inserted into roller slots 60 and 62, respectively, end cap 12 does not rotate during the operation of printer 1. As shown in FIG. 4, end caps 12 and 44 are not rotationally coupled to tube sleeve 11. During operation, the label roll 100 will be unwound to feed labels into the printer 1. The label roll 100 is tightly held by the metal holding springs 106 and 108 securely coupled to the surface of the tube sleeve 11. Therefore, when the label roll 100 rotates, it will pull the tube sleeve 11 to rotate accordingly. Additionally, inside the sections 14 and 46 of the respective stepped end caps 12 and 44, there are respective first and second needle roller bearings 16 and 48 coupled to respective inner walls of the end caps 12 and 44 and encircling the shaft 20. The needle roller bearings 16 and 48 are used to allow low frictional rotation to the shaft 20 and may be obtained from any of a number of standard needle bearing manufacturers.

As noted, shaft 20 is coupled to slip mechanism 23 inside tube sleeve 11. Torsional mechanism 21 comprises a torsion spring 18 and collar 15 and is coupled to slip mechanism 23 (FIG. 4). Slip mechanism 23 has two functional portions. A first portion of slip mechanism 23 prevents torsion spring 18 from achieving torsion in a coil-unwinding rotational direction and a second portion of slip mechanism 23 prevents torsion spring 18 from winding past a threshold value of torsion in a coil winding rotational 10 direction.

The first portion of the slip mechanism 23 that protects the torsion spring 18 from gaining torsion in the coil-unwinding rotational direction includes a metal sleeve 34 and a one way slip clutch 36. In FIG. 4, the torsion spring 18 is positioned inside the tube sleeve 11, next to the first stepped end cap 12, and encircles the shaft 20. In the preferred embodiment, the torsion spring 18 is approximately 1.02 inches long (excluding the bent, extending straight coil parts at both ends). The torsion spring 18 is made up of a coil with a first end of the coil at the right side of the torsion spring 18 bent approximately 90 degrees for correct insertion into a small hole (not shown) of the collar 15 of the first end cap 12. A second end, opposite to the first, of the coil is also bent 90 degrees to facilitate insertion into a similar hole (not shown) in the right end face of the metal sleeve 34, which is next to the torsion spring 18 at the left side. In the preferred embodiment, a plastic sleeve (not shown) is enclosed within the torsion spring 18 to encircle the shaft 20. The plastic sleeve has a lateral length of approximately 1.0 inches and prevents the torsion spring 18 from collapsing or rubbing against the shaft 20 during rotation or winding with torsion. In an alternative embodiment, no plastic sleeve is provided to the present invention.

The metal sleeve 34 is situated next to the torsion spring 18 at the left side and toward the center portion of the shaft 20. The metal sleeve 34 is approximately 0.427 inches long and has an outer diameter of approximately 0.67 inches and an inner diameter of approximately 0.47 of an inch. The metal sleeve 34 encircles the one way slip clutch 36 with an interference fit that prevents rotation between the metal sleeve 34 and an outer ring of the one way slip clutch 36. The one way slip clutch 36 encircles the shaft 20 and is approximately the same length as the metal sleeve 34. The one way slip clutch 36 coupled together with the metal sleeve 34 rotate freely in a first rotational direction (counterclockwise relative to the tube sleeve 11 when seen inward from the first end cap 12) causing the torsion spring 18 to rotate freely without allowing torsion to increase in the rotational direction that would unwind the torsion spring's coils. But, the metal sleeve 34 and the one way slip clutch 36 resist rotation in an opposite rotational direction (clockwise relative to the tube sleeve 11). Thus, they would cause the torsion in the torsion spring 18 to increase when the tube sleeve 11 and shaft 20 rotate counterclockwise and the first end cap 12 is not allowed to rotate relatively.

The torsion of the torsion spring 18 cannot be increased indefinitely. Otherwise, it would eventually halt the shaft 20 and the tube sleeve 11 and, thus, the label roll 100, from rotating. Therefore, the roll tensioner 10 requires the slip mechanism 23 to additionally prevent the torsion of the torsion spring 18 from being increased over a predetermined threshold value, as well as to prevent the torsion spring 18 from accumulating torsion in the coil-unwinding direction. The slip mechanism 23 of the present invention is designed to maintain a roughly constant torsion of the torsion spring 18 at the threshold value when this torsion has reached the threshold value. The metal sleeve 34, the one way slip clutch 36, first and second locking collars 38 and 32, and the shaft 20 then cease rotating when the threshold value is reached, as the tube sleeve 11, tube internal rib support bearings 42, 26, an anti-rotation washer 28, a compression spring 22, a flat washer 24 and first and second felt bushings 40, 30 continue to rotate counterclockwise coupled to the inner diameter of the media roll support tube through holding the springs 106 and 108.

The second portion of slip mechanism 23 that limits torsion of the torsion spring 18 approximately to the threshold value includes first and second locking collars 38, 32, first and second felt bushings 40, 30, the compression spring 22, the anti-rotation washer 28, and the flat washer 24. The first and second locking collars 38, 32 are adapted to rotate with the shaft 20 at a precise axial separation along the shaft 20 with set-screws or other similar clamping means so that the compression spring 22 places both felt bushings 40, 30 under compression constrained by the axial separation of internal tube ribs 35, 25 within the tube sleeve 11. This compression loop starts with the first tube sleeve internal rib 35 and continues with the first felt bushing 40 being pressed against its right side by the first locking collar 38, which is affixed to shaft 20. The second locking collar 32 is also affixed to shaft 20 at such a dimension as to properly compress the compression spring 22 between the stack of the anti-rotation washer 28 and the left side of the internal rib 25 of the tube sleeve 11 to achieve slip torsion at the threshold value between the right face of the first felt bushing 40 and the first locking collar 38 as well as between the right face of second felt bushing 30 and the left face of the anti-rotation washer 28. In other embodiments of the invention, other faces and stacks of parts could be used instead of those mentioned. As generally depicted in FIG. 4, slip mechanism 23 comprises first and second locking collary 38, 32, anti-rotation washer 28, first and second felt bushings 40, 30, compression spring 22, flat washer 24, one way slip clutch 36, metal sleeve 34 and internal tube ribs 25, 35.

When the torsion of the torsion spring 18 increases, but before it reaches the threshold value, the friction between the first felt bushing 40 and the first collar 38, and the similar friction between the second felt bushing 30 and the anti-rotation washer 28, do not allow slip and, thus, transmit counterclockwise rotation from the tube sleeve 11 to the shaft 20 through the first and second locking collars 38, 32. Tabs on the anti-rotation washer 28 at diametrically opposed locations (180 degrees apart) fit into matching notches of the tube sleeve 11 to transmit the rotation from the tube sleeve 11 to the anti-rotation washer 28 and then, through friction face coupling, to the second felt bushing 30. Thereafter, the rotation is transmitted by a higher friction coupling from the second felt bushing 30 to the second locking collar 32 and then to the shaft 20. Similarly, friction between the right face of the first internal support rib 35 and the left face of the first felt bushing 40 transmit rotation from the right face of the first felt bushing 40 to the left face of the first locking collar 38 and to the shaft 20. The shaft 20, in turn, then transmits clockwise rotation to the slip clutch 36 and, through the interference fit, to the metal sleeve 34 and finally to the left end of the torsion spring 18 from the 90 degree bent end of the spring inserted into the hole in the right end face of the metal sleeve 34. When the shaft 20 rotates, the end caps 12 and 44 are kept from being rotated by needle bearings 16 and 48.

Once the torsion spring 18 has reached the threshold torsion value, slip occurs thereafter between the right face of the second felt bushing 30 and the left face of the anti-rotation washer 28 as well as between the right face of the first felt bushing 40 and the left face of the first locking collar 38. From this time, and thereafter with continued counterclockwise rotation of tube sleeve 11, as shown by rotational arrow 200 in FIG. 2, only the tube sleeve 11, the anti-rotation washer 28, the compression spring 22, the flat washer 24 and the first felt bushing 40 continue to rotate counterclockwise with the printable medium roll. The torsion spring 18, the shaft 20, the locking collars 38, 32, the second felt bushing 30, the slip clutch 36, and the metal sleeve 34 remain rotationally still at the amount of torsion for slip to occur between the combination of the right face of the first felt bushing 40 and left face of the first locking collar 38 as well as between the right face of the second felt bushing 30 and the left face of the anti-rotation washer 28. This rotational separation is eased by allowed slip between the shaft 20 and the internal tube rib support bearings 26, 42 which also rotate with the tube sleeve 11 but do not allow rotation to be transmitted to the shaft 20.

The first felt bushing 40 has a ring shape and has an inner diameter similar to an outside diameter of the shaft 20 to allow the shaft 20 to pass through. The first felt bushing 40 is a widely available standard part and persons skilled in the art could find a suitable felt bushing for the present invention from a variety of manufacturers. Operation of this portion of the invention is described in the following example, when the tube sleeve 11 starts to rotate counterclockwise to provide the label strip to the printer 1, the shaft 20 rotates counterclockwise accordingly. Thus, the left end of the torsion spring 18, which has the left bent coil inserted into the metal sleeve 34, will rotate counterclockwise because the shaft 20 forces the metal sleeve 34 and the first locking collar 38 to rotate counterclockwise. However, the right end of the torsion spring 18, which has the right bent coil inserted into collar 15, will not rotate since end cap 12 is inserted into slot 60, which has the hexagonal shape to prevent end cap 12 from rotating. As a result, torsion will be built up in torsion spring 18 until it reaches the threshold value. Therefore, the torsion spring 18, together with the slip clutch 36, the metal sleeve 34, and the shaft 20 will "slip", i.e., rotate clockwise relative to the tube sleeve 11, to maintain the torsion of the torsion spring 18 at approximately the threshold value, as long as the tube sleeve 11 and, thus, the shaft 20 and the torsion spring 18 will continuously rotate during operation. The threshold value is named as the first felt bushing 40 friction threshold value. When the printer 1 stops, there is still remaining torsion in the torsion spring 18. This remaining torsion will exert a torque force on the label roll 100 to pull back the label strip of the label roll 100 and will prevent the label strip from becoming slack.

Also, the one way slip clutch 36 and the first needle bearing 16 together work to prevent the torsion spring 18 from being unwound when the tube sleeve 11 rotates in the clockwise direction (and thus the torsion spring 18 rotates in the counterclockwise direction relative to the tube sleeve 11). As noted, the first needle bearing 16 rotates freely within the first end cap 12 in both rotational directions. When the tube sleeve 11 rotates clockwise, e.g., when a user backs up the label strip, the shaft 20 rotates clockwise accordingly. Both the slip clutch 36 and the torsion spring 18 will not rotate, but, in a sense, they rotate counterclockwise relative to the tube sleeve 11 and the shaft 20. The first needle bearing 16, however, will rotate clockwise relative to the shaft 20 to release any tension built up in the torsion spring 18. Thereby, the one way slip clutch 36 and the first needle bearing 16 protect the torsion spring 18 from being damaged. The one way slip clutch 36 is available from many manufacturers and persons skilled in the art may find many forms of it from the market that are suitable to be used as the one way slip clutch 36 of the present invention.

The first bearing 42 is of round shape with two extrusions positioned 180° apart from each other on the circumference of the first bearing 42. The first locking collar 38, the first felt bushing 40, and the first bearing 42 are generally in ring shape to allow the shaft 20 to pass through. In the preferred embodiment, the first bearing 42 has an outer diameter of approximately 0.44 inch and an inner diameter of approximately 0.32 inch, and each of the extrusions of the first bearing 42 is approximately 0.15 inch wide, approximately 0.04 inch thick, and extends approximately 0.08 inch outward from the outer peripheral rim of the first bearing 42. The first bearing 42 sits on the first circle rib 35 of the inner surface of the tube sleeve 11. The two extrusions of the first bearing 42 are inserted into respective recesses of the first internal support rib 35 to press against the first internal support rib 35, and they cause the first bearing 42 to act as a stop to prevent the first bearing 42 from moving toward the center of the tube sleeve 11. By this configuration, the first bearing 42, the first felt bushing 40, and the first locking collar 38 act together to keep the metal sleeve 34 and the slip clutch 36 near the torsion spring 18.

On the end of the tube sleeve 11 next to the second end cap 44, there is the second locking collar 32 encircling the shaft 20. The second locking collar 32 is serially coupled to, toward the center of the tube sleeve 11, the second felt bushing 30 and the anti-rotation washer 28. Again, the second locking collar 32 is in tubular shape, and the second felt bushing 30 and the anti-rotation washer 28 are generally in ring shape to allow the shaft 20 to pass through. The anti-rotation washer 28 as previously stated also has two extrusions located at the outer circumference of the anti-rotation washer 28 and spaced 180° apart from each other. The anti-rotation washer 28 has an outer diameter of approximately 0.7 inch, an inner diameter of approximately 0.33 inch, and a thickness of approximately 0.04 inch. Each of the two extrusions of the anti-rotation washer 28 is approximately 0.18 inch wide, 0.04 inch thick, and extends approximately 0.09 inch outward of the outer peripheral rim of the first washer 28 respectively. The two extrusions of the anti-rotation washer 28 respectively sit on two washer recesses located at the inner surface of the tube sleeve 11. Each of the two washer recesses has sufficient room to allow slight lateral axial movements of the anti-rotation washer 28. In this way, the extrusions do not interfere with the slip mechanism 23 compression loop.

Further toward the center of the tube sleeve 11, the compression spring 22 (approximately 2.5 inches long) tightly pushes against the anti-rotation washer 28 at a first end and against the flat washer 24 at a second end, opposite to the first end. The compression spring 22 is approximately 2.5 inches long prior to being compressed, and it has an outer diameter of approximately 0.72 inch. The flat washer 24 pushes, in response to the push of the compression spring 22, against the second inner support rib 25 and the second bearing 26. The flat washer 24 is of ring shape and has an outer diameter of approximately 0.7 inch and an inner diameter of approximately 0.32 inch to allow the shaft 20 to pass through. The second bearing 26 has a similar form and size of the first bearing 42, and it sits on the second inner support rib 25 of the tube sleeve 11. Similarly, two extrusions of the second bearing 26 are inserted in respective recesses of the second inner support rib 25. The two extrusions of the second bearing 26 press against the second inner support rib 25 and they also act as a stop to prevent the second bearing 26 from moving toward the center of the tube sleeve 11. As a result, compression spring 22 is trapped between the anti-rotation washer and the flat washer 28, 24. In one embodiment, the anti-rotation washer and the flat washer 28, 24 are made of metal materials, such as aluminum materials, and the first and second bearings 42 and 26 are made of plastic materials. However, any other materials suitable to manufacture the washers and bearings according to the present invention may be used.

As mentioned, the compression spring 22 presses the anti-rotation washer 28 and, thus, the second felt bushing 30 and the second locking collar 32. In response to a pressing force from the compression spring 22, the second locking collar 32 is fixed to the shaft 20 and aids in providing the threshold torsion to the tube sleeve 11. The compression spring 22 establishes the above-mentioned felt bushing friction threshold value of the torsion in the torsion spring 18, which causes the slip mechanism 23 to slip at the threshold torsion. Therefore, by choosing a proper compression spring 22, which is widely available in the market, a manufacturer of the printer 1 may characterize how much of the torsion is needed until the shaft 20 will slip in an opposite rotational direction relative to that of the tube sleeve 11 during operation.

When the printer 1 starts printing labels, a platen of the printer 1 will starting pulling the label strip of the label roll 100 into the printer 1. Since the label roll 100 is tightly mounted on the tube sleeve 11 by the holding springs 106 and 108, the tube sleeve 11 of the roll tensioner 10 will be pulled to start rotating in a first rotational direction (counterclockwise if viewed from the right side of the printer 1) to feed labels toward the print head. One end of the torsion spring 18 is engaged in the collar 15 of the first end cap 12, which does not rotate during operation. The tube sleeve 11 thus rotates against the first end cap 12 and urges the torsion spring 18 to wind up. This causes the torsion to be built up in the torsion spring 18. When the torsion is continually building up, the torsion spring 18 urges the locking collars 38, 32 to rotate the shaft 20. After being engaged by the locking collars 38, 32, the shaft 20 will still not slip and will also rotate unless the torsion provided by the torsion spring 18 is greater than or equal to the felt bushing friction threshold value. Once the torsion reaches the threshold value, the torsion spring 18 slips in a second rotational direction, opposite to the first, and maintains the torsion in the torsion spring 18 at an approximately constant value. When the printer 1 stops printing, there is still remaining torsion in the torsion spring 18 to provide tension on a label strip and to prevent slack of the label strip. The remaining torsion also allows a user to back up the label strip to some extent, i.e., until the torsion spring 18 releases all torsion stored in it, without causing slack of the label strip.

From the foregoing, it will be appreciated that, although specific embodiments of the invention have been described herein for purposes of illustration, various modifications may be made without deviating from the spirit and scope of the invention. For example, the roll tensioner may be used in any number of imaging devices to prevent slack of an image medium used in the imaging devices. The dimensions of various parts of the invention may be changed to fit into different imaging devices of different sizes. Various compression springs and torsion springs available in the market may also be adopted by a person skilled in the art to provide a suitable torsion of the roll tensioner for any specific imaging device according to the present invention. Furthermore, the manufacturing materials of various parts of the invention may also be changed.

What is claimed is:

1. A device adapted to be coupled into an imaging device, comprising:

a tubular sleeve, said sleeve being adapted to rotate bidirectionally;

a shaft rotatably inserted in said sleeve;

a first end cap coupled to said shaft at a first end, said first end cap having an inner tunnel adapted to allow said shaft to pass through and having a center section of generally hexagonal shape on outer periphery;

a second end cap coupled to said shaft at a second end, opposite to the first, said second end cap having an inner tunnel adapted to allow said shaft to pass through and having a center section of generally cylindrical shape on the outer periphery;

a torsion mechanism positioned in said sleeve and encircling said shaft; and a slip mechanism positioned in said sleeve and coupled to said torsion mechanism, said slip mechanism being adapted to cause said torsion mechanism to rotate freely in a first rotational direction relative to said tubular sleeve and being adapted to cause said torsion mechanism to resist rotation in a second rotational direction, opposite to the first, until a torsion in the torsion mechanism is increased to reach a predetermined threshold value, said slip mechanism maintaining the torsion of the torsion mechanism at approximately the threshold value when the torsion reaches the threshold value.

2. The device of claim 1, wherein said first and second end caps are adapted to be inserted into respective receptive slots located in the imaging device, the receptive slots respectively having matching shapes to receive the center sections of said first and second end caps to prevent said first end cap from rotating once the first end cap is mounted thereon and to prevent said second end cap from being inserted into the receptive slot designated for the first end cap.

3. The device of claim 1, further comprising:

a first roller bearing inserted inside said first end cap, said first roller bearing encircling said shaft to provide a low friction bidirectional rotation to said shaft; and a second roller bearing inserted inside said second end cap, said second roller bearing encircling said shaft to provide a low friction bidirectional rotation to said shaft.

4. The device of claimed 1, wherein said torsion mechanism comprises a coil spring encircling said shaft, said coil spring having a first bent extrusion at a first end coupled to said first end cap.

5. The device of claim 1, further comprising a pair of elastic holding means respectively secured to the center of an outer surface of said tubular sleeve at opposite sides, said elastic holding means being adapted to hold a medium roll encircling said tubular sleeve.

6. The device of claim 5, wherein said elastic holding means respectively comprise at least one metal plate spring securely mounted on respective recesses on the surface of said tubular sleeve.

7. The device of claim 1, further comprising:

two sets of notches respectively located on the outer surface of said tubular sleeve at opposite ends; and two sets of indicators respective located on the outer surface of said tubular sleeve and positioned adjacent to said sets of notches for indicative purposes.

8. The device of claim 7, further comprising a pair of retainers wherein each of said pair of retainers respectively comprises a clip spring on an inner wall of a center hole of the respective retainer to allow said retainers to be mounted on said tubular sleeve by snapping or rotating said pair of retainers on the respective sets of notches.

9. A device adapted to be coupled into an imaging device, comprising:

a tubular sleeve, said sleeve being adapted to rotate bidirectionally;

a shaft rotatably inserted in said sleeve;

a torsion mechanism positioned in said sleeve and encircling said shaft;

a slip mechanism positioned in said sleeve and coupled to said torsion mechanism, said slip mechanism being adapted to cause said torsion mechanism to rotate freely in a first rotational direction relative to said tubular sleeve and being adapted to cause said torsion mechanism to resist rotation in a second rotational direction, opposite to the first, until a torsion in the torsion mechanism is increased to reach a predetermined threshold value, said slip mechanism maintaining the torsion of the torsion mechanism at approximately the threshold value when the torsion reaches the threshold value;

a clutch mechanism coupled to said torsion mechanism and encircling said shaft, said clutch mechanism being adapted to allow said torsion mechanism to rotate freely in the first rotational direction and to resist in the second rotational direction;

a slip means coupled to said clutch mechanism and affixed to said shaft, said slip means being adapted to prevent the torsion of said torsion mechanism to increase over the threshold value;

a slip clutch encircling said shaft, said slip clutch being adapted to resist rotation in the second rotational direction and to rotate freely in the first rotational direction; and a clutch sleeve securely coupled to said torsion mechanism at a first end and encircling said slip clutch, said clutch sleeve being adapted to rotate freely in the first rotational direction and to resist rotation in the second rotational direction by said slip clutch.

10. The device of claim 9, wherein said slip means comprises:

a compression means encircling said shaft, said compression being adapted to determine the threshold value of the tension of the torsion mechanism;

first and second locking collars, said first locking collar being coupled to said clutch mechanism at a second end, said first and second locking collars encircling said shaft and being adapted to lock said shaft; and first and second felt bushings respectively coupled to said first and second locking collars.

11. The device of claim 10, wherein said slip means further comprises:

first and second washers respectively coupled to said compression means at opposite ends, said first washer being coupled to said second felt bushing; and first and second support bearings, said first and second support bearings being securely coupled to first and second inner circular ribs of said tubular sleeve respectively wherein said first support bearing is pressed against said first felt bushing and said second support bearing is pressed against said second washer.

12. The device of claim 10, wherein said compressing means comprises a compression spring encircling said shaft.

13. A tension system adapted to be incorporated into an imaging device, comprising:

a support frame adapted to be positioned within the imaging device, said support frame having first and second slots respectively located at opposite ends of said support frame wherein said first slot has a hexagonal contour at its receptive bottom and said second slot has a round contour at its receptive bottom; and a torsion roller, said torsion roller having first and second end caps wherein a portion of said first end cap has a keyed periphery adapted to be inserted into the first slot and a portion of said second end cap has a round periphery adapted to be inserted into the second slot and the first slot is small enough to not accept the second end cap, said torsion roller being adapted into be rotated freely in a first rotational direction and being adapted to resist rotation in a second rotational direction, opposite to the first, until a torsion within said torsion roller is increased to reach a predetermined threshold value.

14. The torsion system of claim 13, wherein said torsion roller comprises:

a tubular sleeve, said tubular sleeve being adapted to rotate bidirectionally;

a shaft rotatably inserted through said sleeve;

a torsion mechanism positioned in said sleeve and encircling said shaft near a first end, said torsion mechanism being securely coupled to the first end cap at a first end;

a clutch mechanism positioned in said tubular sleeve, said clutch mechanism being securely coupled to said torsion mechanism and being adapted to cause said torsion mechanism to rotate freely in the second rotational direction relative to said tubular sleeve and to resist rotation in the first rotational direction;

a compressing mechanism positioned in said tubular sleeve and encircling said shaft near a second end, opposite to the first, said compression mechanism being adapted to define the threshold torsion value; and a slip mechanism coupled to said compression mechanism and to said clutch mechanism, said slip mechanism being adapted to cause said clutch mechanism and said torsion mechanism to rotate in the first rotational direction when the torsion of the torsion mechanism reaches the threshold value.

15. The torsion system of claim 14, wherein said slip mechanism comprises:

first and second locking collars, said first locking collar being coupled to said clutch mechanism, said first and second locking collars encircling said shaft and being adapted to lock said shaft;

first and second felt bushings respectively coupled to said first and second locking collars;

first and second washers respectively coupled to said compressing mechanism at opposite ends, said first washer being coupled to said second felt bushing; and first and second support bearings, said first and second support bearings being securely coupled to first and second inner circular ribs of said tubular sleeve respectively wherein said first support bearing is pressed against said first felt bushing and said second support bearing is pressed against said second washer.

16. The torsion system of claim 14, further comprising:

a first roller bearing inserted inside said first end cap, said first roller bearing encircling said shaft to provide a low friction bidirectional rotation to said shaft; and a second roller bearing inserted inside said second end cap, said second roller bearing encircling said shaft to provide a low friction bidirectional rotation to said shaft.

17. The torsion system of claim 14, further comprising:

a pair of elastic holding means respectively secured to the center of an outer surface of said tubular sleeve at opposite sides, said elastic holding means being adapted to hold a medium roll encircling said tubular sleeve;

two sets of notches respectively located on the outer surface of said tubular sleeve at opposite ends; and two sets of indicators respective located on the outer surface of said tubular sleeve and positioned adjacent to said sets of notches for indicative purposes.

18. The torsion system of claim 17, further comprising a pair of retainers, each of said pair of retainers respectively comprising a snap spring on an inner wall of a center hole of the respective retainer to allow said retainers to be mounted on said tubular sleeve by snapping or rotating said pair of retainers on the respective sets of notches.

19. A device adapted to be coupled into an imaging device, comprising:

a tubular sleeve, said sleeve being adapted to rotate bidirectionally;

a shaft rotatably inserted in said sleeve;

a torsion mechanism positioned in said sleeve and encircling said shaft; and a slip means positioned in said sleeve and coupled to said shaft, said slip mechanism being adapted to cause said torsion mechanism to rotate freely in a first rotational direction relative to said tubular sleeve and to resist rotation in a second rotational direction, opposite to the first, until torsion in the torsion mechanism is increased to reach a predetermined threshold value, said slip means maintaining the torsion of the torsion mechanism at approximately the threshold value when the torsion reaches the threshold value and being adapted solely to prevent the torsion of said torsion mechanism from increasing over the threshold value independent of the rate of accumulation of torsion in the torsion mechanism.

* * * * *